US006202788B1

(12) United States Patent
Busch et al.

(10) Patent No.: US 6,202,788 B1
(45) Date of Patent: Mar. 20, 2001

(54) LATCH FOR SCAFFOLD

(75) Inventors: Wolfgang Busch, Hagen; Klaus Buttgereit, Plettenberg, both of (DE)

(73) Assignee: Plettac AG, Plettenberg (DE)

( * ) Notice: Subject to any disclaimer, the term of this patent is extended or adjusted under 35 U.S.C. 154(b) by 0 days.

(21) Appl. No.: 09/072,376

(22) Filed: May 4, 1998

(30) Foreign Application Priority Data

May 7, 1997 (DE) ..... 197 19 285

(51) Int. Cl.[7] ..... E04G 7/00
(52) U.S. Cl. ..... 182/186.8; 403/49
(58) Field of Search ..... 182/186.8, 186.7, 182/179.1; 292/230; 403/49

(56) References Cited

U.S. PATENT DOCUMENTS

| | | | | |
|---|---|---|---|---|
| 516,393 | * | 3/1894 | Johnston . | |
| 624,080 | * | 5/1899 | Pease | 292/230 |
| 758,416 | * | 4/1904 | Clapp | 292/230 |
| 2,698,552 | * | 1/1955 | Smith . | |
| 2,701,167 | * | 2/1955 | Kirkpatrick . | |
| 2,749,168 | * | 6/1956 | Harris | 292/230 |
| 2,810,612 | * | 10/1957 | Weisz | 403/49 |
| 2,847,259 | * | 8/1958 | Beatty | 403/49 |
| 2,914,792 | * | 12/1959 | Campbell | 292/230 |
| 3,091,489 | * | 5/1963 | Jackson | 430/49 |
| 4,004,393 | * | 1/1977 | Morris . | |
| 4,289,215 | * | 9/1981 | Robinson | 182/92 |
| 5,186,568 | * | 2/1993 | Falardeau . | |

FOREIGN PATENT DOCUMENTS 44 35 417 A1 4/1996 (DE) .

* cited by examiner

*Primary Examiner*—Alvin Chin-Shue
(74) *Attorney, Agent, or Firm*—Akin, Gump, Strauss, Hauer, & Feld, L.L.P.

(57) ABSTRACT

The invention relates to a pivoting pin (1) for use on scaffold vertical frames (6) as a connecting element for scaffold bars and braces extending in horizontal and/or vertical direction, having a sleeve-like support (2) that may be welded on the vertical frame (6), which support on its bottom has a slot (3) extending in longitudinal direction which is larger in width than a fall bar (5) fitted with a bearing in the interior of support (2) and pivoting around a horizontal axis, which fall bar protrudes downwardly from the slot (3) when in its vertical lock position and may be pivoted out of same solely towards the welded end of the support (2) in the interior thereof to reach its horizontal open position, the pivoting angle being confined to about 90°. In order to ensure functional security, particularly when exchanging or replacing the fall bar (5) under unfavorable ambient conditions on the building site, the invention suggests that the slot (3) be closed at its front, the fall bar (5) coming to a stop at the slot front wall when pivoted in forward direction into its lock position.

6 Claims, 1 Drawing Sheet

LATCH FOR SCAFFOLD

The invention relates to a pivoting pin for use on scaffold vertical frames as a connecting element for scaffold bars and braces extending in horizontal and/or vertical direction, having a sleeve-like support that may be welded on the vertical frame, which support on its bottom has a slot extending in longitudinal direction which is larger in width than a fall bar fitted with a bearing in the support interior and pivoting around a horizontal axis, which fall bar protrudes downwardly from the slot when in its vertical lock position and may be pivoted out of same solely towards the welded end of the support in the interior thereof to reach its horizontal open position, the pivoting angle being confined to about 90°.

Pivoting pins are welded on vertical tubes of scaffold frames, protruding inwardly and outwardly. They are used to fasten the horizontal back rails between adjacent scaffold frames and the diagonals in order to reinforce the scaffold area.

Fastening the scaffold bars and braces is effected by mounting these components provided with a transverse boring onto the horizontally projecting support of the pivoting pin. Initially, the fall bar of the pivoting pin is pivoted into its horizontal open position into the support cross-section, subsequently falling into its vertical lock position as a result of its gravity, protruding downwardly over the cross-section of the support, thereby overlapping the diameter of the through-boring. By confining the pivoting angle of the fall bar to about 90°, the latter cannot be pivoted forwardly beyond its lock position. In this way, a mounted scaffold element is prevented from accidentally slipping off the support of the pivoting pin. Namely, disassembly requires that the fall bar be pivoted back by hand in direction of the welded end of the support into its horizontal open position.

Such a gravity-operated pivoting pin having all the above-mentioned features is known from DE 44 35 417 A1, for example. It has a support made of a steel or aluminum sheet cut to size and bent in a sleeve-like fashion, which is of sleeve-like shape closed at the top over its entire length and has a continuous slot at its bottom which extends in longitudinal direction and is larger in width than the thickness of the fall bar fitted with a bearing in the sleeve interior. The fall bar pivoting angle from the vertical lock position towards the welded end of the support is confined to about 90° by a supporting surface contacting the closed top of the support. To this end, the fall bar has a protrusion, for example, permitting a pivoting motion from the vertical in one direction only.

On the one hand, the advantages of the above-mentioned design of a pivoting pin are its sleeve-like shape preventing penetration of cement and the like into the fall bar area of motion and allowing efficient manufacture and assembly. On the other hand, particularly simple handling results from the fact that the securing bar protrudes from the support in downward direction only. Namely, when mounting scaffold components, the securing bar will automatically pivot into its open position and subsequently fall into its vertical lock position as a result of its gravity.

One disadvantage may result, however, if the fall bar is lost or damaged during exceptionally heavy strain on the building site, so that it must be exchanged or replaced on site. If the fall bar—in case of unawareness of its function—is inserted the wrong way around, it can only be pivoted then from its lock position in forward direction, i.e., away from the welded end of the support to reach its open position. As a result, a mounted scaffold component is no longer secured against slipping off the support.

On the basis of these problems, it is the object of the invention to provide a pivoting pin where the functional capability is improved in such a way that security risks are avoided even upon repair by non-qualified personnel.

To accomplish said object, the invention suggests on the basis of prior art mentioned at the beginning that the slot be closed in front, the fall bar coming to a stop at the slot front wall when pivoted in forward direction into its lock position.

In contrast to the generic prior art, the slot at the bottom of the support in this invention does not extend over the entire length of the support, but terminates before the front end of same, i.e., the outer end as viewed from the frame side. The slot dimensions, the position of the pivoting axis, and the fall bar dimensions are adjusted in such a way that the fall bar hanging in lock position will move inside, coming to a stop at the slot front end as soon as the attempt is made to pivot it out of its lock position in forward direction, i.e., in outward direction. The fall bar itself is designed in the form of a small flat plate which has a bearing bore at the top and is of mirror-symmetrical design with respect to its longitudinal direction.

The particular advantage of the invention results from the fact that the slot front end defines a limit stop for the front edge of the fall bar, so that the latter is no longer required to be provided with unsymmetrical supporting surfaces. In this way, the functional capability of the fall bar is ensured in any case, regardless of the mounting position of same. Owing to the invention, improper mounting is absolutely impossible, so that security is always provided when exchanging or replacing fall bars, even under unfavorable conditions on the building site.

The advantageous features of the generic prior art are completely maintained in the design of the invention. Thus, for example, a largely closed area of motion for the pivoting pin is present at least at the top as a result of the sleeve-like shape of the support, so that building material falling down, such as mortar or concrete cannot accidentally penetrate and impair the function. The fall bar therefore remains easily movable even under severe conditions of use and may be unlocked by hand anytime. Owing to the fall bar pivoting back when mounted and subsequently falling back into lock position due to its gravity, convenient handling is maintained as well.

For example, the pivoting pin of the invention may be manufactured simply and efficiently by sawing or milling a short, non-continuous longitudinal slot into a tube section. The production is even more efficient when the sleeve-like support is bent up from a flat metal sheet which is punched out appropriately. Thus, a particularly efficient mass production may be performed, as is the case in prior art.

With respect to production technics, it is particularly advantageous that the support has at least one zinc drain hole in the area of the welded end. Such holes, e.g., a boring of a few millimeters in diameter should be introduced into the top or the side of the support, e.g., at a small distance to the welded end, to allow drainage of the liquid zinc from the support interior during galvanizing, with lowest possible formation of residues which might impair the functional capability.

Furthermore, it is advantageous that the support has a maintenance hole at its top within the pivoting area of the horizontal open position of the fall bar. For example, said maintenance hole may be a boring, the diameter of which is dimensioned in such a way that on the one hand, the risk of impairing the functional security through penetration of foreign matter or dirt is relatively low while on the other hand, the sleeve interior can be accessed using a pin-like tool. Using a mandrel, screwdriver or the like which is introduced from the top through the maintenance hole, dirt possibly present in the sleeve interior may be pushed downwards and out through the slot, so that the fall bar can be pivoted into its open position. Furthermore, a fall bar possibly jammed in its open position may also be released by a short push or strike.

Conveniently, the support is provided with an assembly score at its front side. For example, a groove or notch may be milled into the top of the support at its front end as assembly score, indicating proper orientation of the pivoting pin at the frame tube. Such a groove or notch is particularly advantageous for that reason because unambiguous and reliable orientation in fully automated production machinery can be effected without problems.

With reference to the drawings, one embodiment of a pivoting pin according to the invention will be illustrated in more detail.

Figure 1:
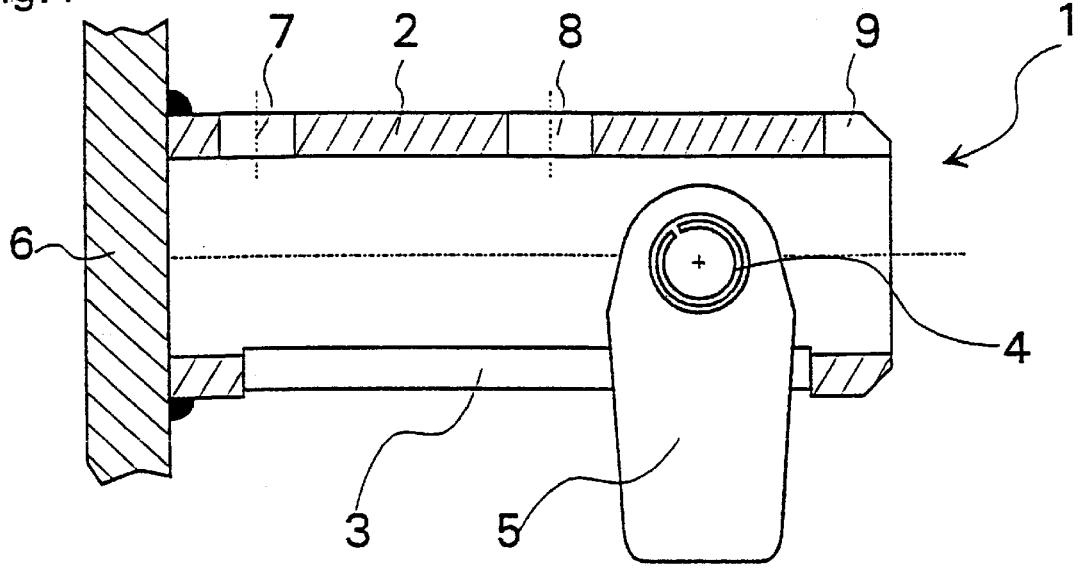
FIG. 1 shows a longitudinal section through a pivoting pin of the invention in lock position, welded on a vertical frame.

In FIG. 1, the pivoting pin as a whole is denoted by reference number 1. It has a sleeve-like support 2 essentially designed as a tubular sleeve provided with a slot 3 at its bottom. As is clearly seen from this illustration, the slot does not go through in longitudinal direction but terminates before the front end of support 2.

By sleeve-like bending up the support 2 from a punched metal sheet, its production is particularly efficient.

A horizontal pivoting axis 4 is inserted in the front area of support 2 across the longitudinal direction of same. A pivoting fall bar 5 fitted with a bearing is provided thereon. Essentially, it has the form of a small flat plate and is of mirror-symmetrical shape with respect to its longitudinal direction.

The rear end of support 2 is welded on the tube of a vertical frame 6.

The same reference numbers as in FIG. 1 will be used in FIGS. 2 and 3 hereinbelow.

FIG. 1 illustrates the pivoting pin 1 in lock position. Here, the fall bar 5 which is in its vertical lock position projects downwardly from slot 3 over the cross-section of support 2. It is clear from this illustration that the fall bar 5 cannot be pivoted in forward direction because the front edge of same would come to a stop at the front end of slot 3.

The dimensions of slot 3 and fall bar 5, as well as the position of pivoting axis 4 are preferably selected in such a way that the fall bar 5 in lock position as illustrated virtually contacts the front end of slot 3 or is immediately before the limit stop.

Figure 2:
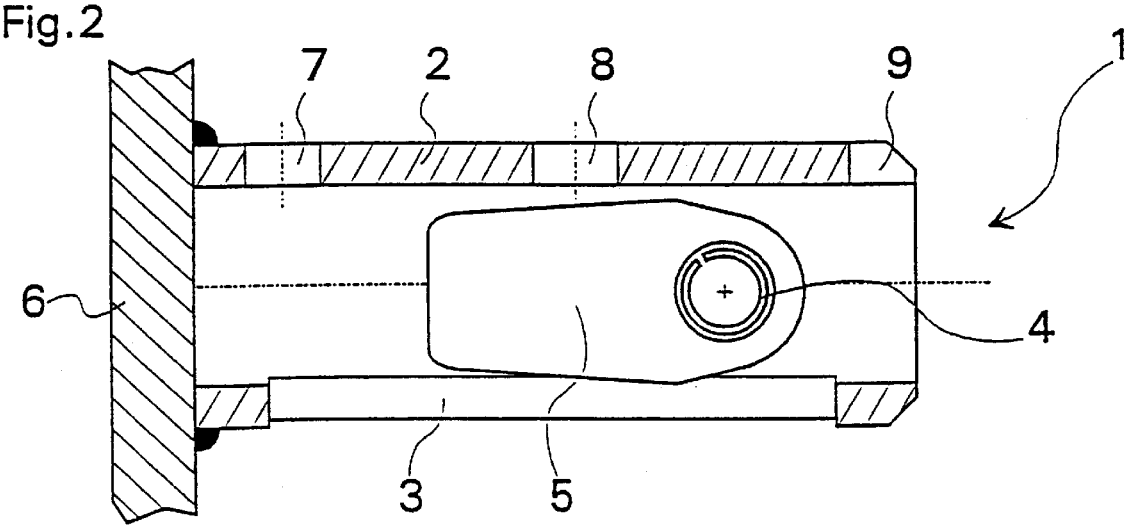
FIG. 2 shows a view of a pivoting pin according to FIG. 1 in open position.

FIG. 2 illustrates the pivoting pin 1 in open position. Here, the fall bar 5 has been pivoted by 90° in backward direction so as to be completely within support 2.

Figure 3:
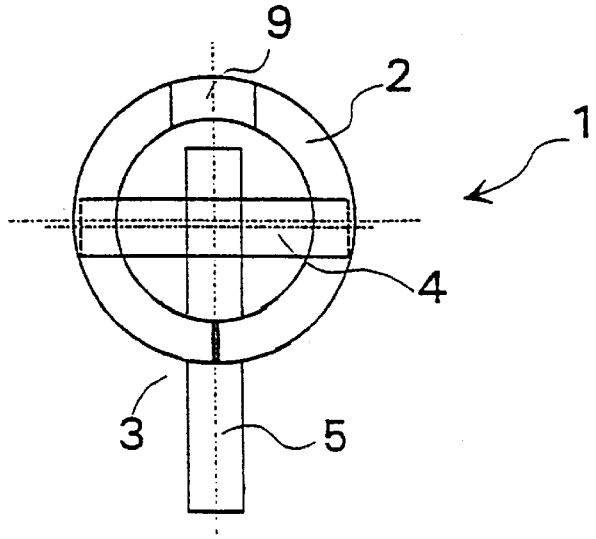
FIG. 3 shows a front view of the pivoting pin according to FIG. 1 and FIG. 2.

Again, FIG. 3 explains the arrangement of the individual components of pivoting pin 1 in a front view, with the fall bar 5 being in lock position.

A zinc drain boring 7 and a maintenance boring 8 are introduced at the top of support 2. The former is situated near the welded end, while the maintenance boring 8 is arranged above the pivoting range of fall bar 5.

Reference number 9 denotes an assembly-aiding groove introduced at the top of the front end of support 2, wherein an assembly or transportation tool not represented herein can engage.

A pivoting pin 1 according to the invention is used as follows:

At a vertically erected vertical frame 6, the fall bar 5 of pivoting pin 1 is in its lock position according to FIG. 1 or FIG. 3 due to its gravity. In mounting a scaffold component such as a bar or a brace, the through-boring of same which is somewhat larger in dimension than the diameter of support 2 is mounted thereon, whereby the fall bar 5 is automatically pivoted into its open position as illustrated in FIG. 2. As soon as the scaffold component has been pushed onto support 2 far enough to clear the range of motion of fall bar 5, the latter will automatically fall back into the lock position according to FIG. 1 due to its gravity.

Now, if the scaffold component is exposed to a horizontal load in outward direction, it will come to a stop at the rear side of the protruding part of fall bar 5 which in turn comes to a stop when moving forward inside towards the front end of slot 3. In this lock position, however, it will be blocked so that the mounted scaffold component cannot slip off.

The zinc drain boring 7 and the maintenance boring 8 are dimensioned sufficiently small, so that no coarse building material which might impair the function of fall bar 5 can get in the interior of support 2. In the event malfunctions should arise, however, tightly adhering dirt may be removed using a pin- or mandrel-like tool such as a screwdriver or the like which is introduced from the top and pushed through maintenance hole 8. In much the same way, a fall bar 5 jammed in its open position according to FIG. 2 can be released.

Owing to the symmetrical design of fall bar 5, the functional capability is impaired in no way upon exchange or replacement, because improper mounting is virtually impossible.

What is claimed is:

1. A pivoting pin for use on scaffold vertical frames as a connecting element for scaffold bars and braces extending in horizontal and/or vertical directions, comprising a tubular sleeve-like support having a first end that may be welded on the vertical frame, the support having a bottom with a slot extending in a longitudinal direction through the bottom, the slot being larger in width than a fall bar, the fall bar having a fixed horizontal pivot axis about a horizontal bearing in an interior of the support, the fall bar being pivotable about said axis to protrude downwardly from the slot into a vertical lock position and may be pivoted out of the vertical lock position solely towards a the first end of the support into the interior of the support to reach a horizontal open position, the pivoting angle being confined to 90° between to the horizontal open position, and the vertical lock position the slot (3) being closed by a front wall, the fall bar (5) coming to a stop at the slot front wall when pivoted in a forward direction to the lock position of 90° with respect to the horizontal open position.

2. The pivoting pin according to claim 1, wherein the fall bar (5) is of mirror-symmetrical design with respect to its longitudinal direction.

3. The pivoting pin according to claim 1, wherein the support (2) is designed as a tubular sleeve of circular cross-section.

4. The pivoting pin according to claim 1, wherein the support (2) has at least one zinc drain hole (7) in the area of the first end.

5. The pivoting pin according to claim 1, wherein a maintenance hole (8) is located on top of the support (2) within a pivoting range of the horizontal, open position of the fall bar (5).

6. The pivoting pin according to claim 1, wherein the support (2) is provided with an assembly score (9) at its other end.

* * * * *